US005577819A

United States Patent [19]

Olsen

[11] Patent Number: 5,577,819

[45] Date of Patent: Nov. 26, 1996

[54] BATHROOM APPLIANCE CABINET

[76] Inventor: Danny H. Olsen, 575 E. 1950 N., North Ogden, Utah 84414

[21] Appl. No.: 236,185

[22] Filed: May 2, 1994

[51] Int. Cl.[6] ..... A47B 67/00

[52] U.S. Cl. ..... 312/242; 312/245; 312/209; 312/223.6

[58] Field of Search ..... 312/242, 245, 312/224, 209, 236, 292, 223.1, 223.6; D6/524, 540, 553, 567, 568, 573, 574; 108/42, 40, 48

[56] References Cited

U.S. PATENT DOCUMENTS

| | | | |
|---|---|---|---|
| 2,181,065 | 11/1939 | Pfeiffer et al. | 312/223.1 |
| 2,582,812 | 1/1952 | Wise | 312/242 |
| 2,678,252 | 5/1954 | Swearingen | 312/242 X |
| 3,008,785 | 11/1961 | Gehrs | 312/242 X |
| 3,305,284 | 2/1967 | Dusterhoft | 312/242 |
| 3,477,775 | 11/1969 | Trent | 312/242 X |
| 3,807,824 | 4/1974 | Hayes | 312/223.1 |
| 4,134,625 | 1/1979 | Palka | 312/245 |
| 4,155,609 | 5/1979 | Skafte et al. | 312/245 |
| 4,209,212 | 6/1980 | McGoldrick | 312/245 |
| 4,248,254 | 2/1981 | Trimble | 312/209 X |
| 4,324,446 | 4/1982 | LeSage | 312/245 |
| 4,681,380 | 7/1987 | Carlin | 312/242 |
| 4,909,158 | 3/1990 | Sorensen | 108/42 X |

*Primary Examiner*—Peter M. Cuomo
*Assistant Examiner*—Robert J. Sandy
*Attorney, Agent, or Firm*—A. Ray Osburn

[57] ABSTRACT

A bathroom storage cabinet for electrically operated appliances such as hair dryers and hair curlers. Receptacles for the appliance cords are provided within the cabinet by a power bar, which is placed within an interior compartment utilized for neatly storing coils of electric cord excess length. A lower shelf and barrier wall retains the length of cord actually needed, so that a front door may be closed neatly flush with the cabinet, equipped with a magnetic latch arrangement. A lowermost compartment provides room for non-electrical brushes, combs and other bathroom paraphernalia and materials. The cabinet is adapted for installation embedded into a bathroom wall, or hanging from the face of the bathroom wall, or resting upon the bathroom counter.

2 Claims, 3 Drawing Sheets

BATHROOM APPLIANCE CABINET

BACKGROUND OF THE INVENTION

1. Field

The invention is concerned with storage cabinets for implements and devices commonly used in bathrooms.

2. State of the Art

Common toilet articles, such as toothbrushes, hairbrushes, combs, electric powered curling irons, hairbrushes and hair dryers are commonly used, and stored between uses, in bathrooms. Smaller items such as manual brushes and combs commonly repose between uses in medicine cabinets or drawers. Wall mounted holders suspend toothbrushes. Electrically powered items, laboriously wrapped around with associated cords, clutter counters, drawers and available cabinets.

Such bathroom clutter and confusion has resulted in the design of a number of storage cabinets. A toothbrush and dental floss cabinet (U.S. Pat. No. 4,248,254), also providing for combs and brushes, has ingenuously attached strings and spring-loaded reels for automatic retraction of the items into storage positions between uses. The elaborate curling iron organizer disclosed in U.S. Pat. No. 5,054,615, however provides no electrical receptacles. The professional "barber caddie" of U.S. Pat. No. 3,460,899 is also shy of convenient electrical outlets. Another specialized storage cabinet, U.S. Pat. No. 2,181,065 discloses an electric razor case attached to a bathroom wall. Winding posts in the cabinet accept the cord for storage, the cord being further secured by a dead receptacle within the cabinet accepting the male end of the cord. For use, however, an outside live receptacle must be accessible.

None of the previous devices allows simultaneous orderly storage of a number of electrical bathroom appliances and associated cords. Such a cabinet is needed.

BRIEF SUMMARY OF THE INVENTION

The disadvantages and shortcomings of previous bathroom storage cabinets are eliminated or substantially alleviated by the present invention, which provides such a cabinet permitting compact orderly storage of bathroom electrical appliances between uses. The cabinet incorporates storage provisions for the excess length of electrical cord commonly provided with such instruments, along with a plug-in receptacle electric power bar within the cabinet, the latter preferably providing sufficient receptacles for simultaneous use with the cords of a number of stored electrically powered appliances. With the cabinet, no plugging or unplugging of cords is required between uses. There is no irritating tangle of electric cords in the bathroom, during or between uses. According to a preferred embodiment of the invention, the cord plug-in and storage provisions are included in an interior compartment of the cabinet. This compartment may advantageously be formed between a downwardly spaced shelf and the top wall member of the cabinet. Vertical, front opening slots in the horizontal shelf permit placement and storage of the cord end plugs, along with coils of excessive lengths of the cords. The compartment may be advantageously provided with a vertically hanging door member suspended from horizontally aligned hinges along its upper edge. Spaced apart forwardly extending appliance suspension hooks are installed into the door member. The cabinet is preferably provided with a vertically hinged main door, along with magnetic latching means.

Advantageously, a mirror may be provided on the inside of the main door to facilitate implement use without concern to the proximity of regular bathroom mirrors. The cabinet may be installed resting upon a bathroom counter, or may be inserted partially within the bathroom wall at any selected elevation.

It is therefore the principal object of the invention to provide an improved bathroom storage device for electrically powered appliances.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
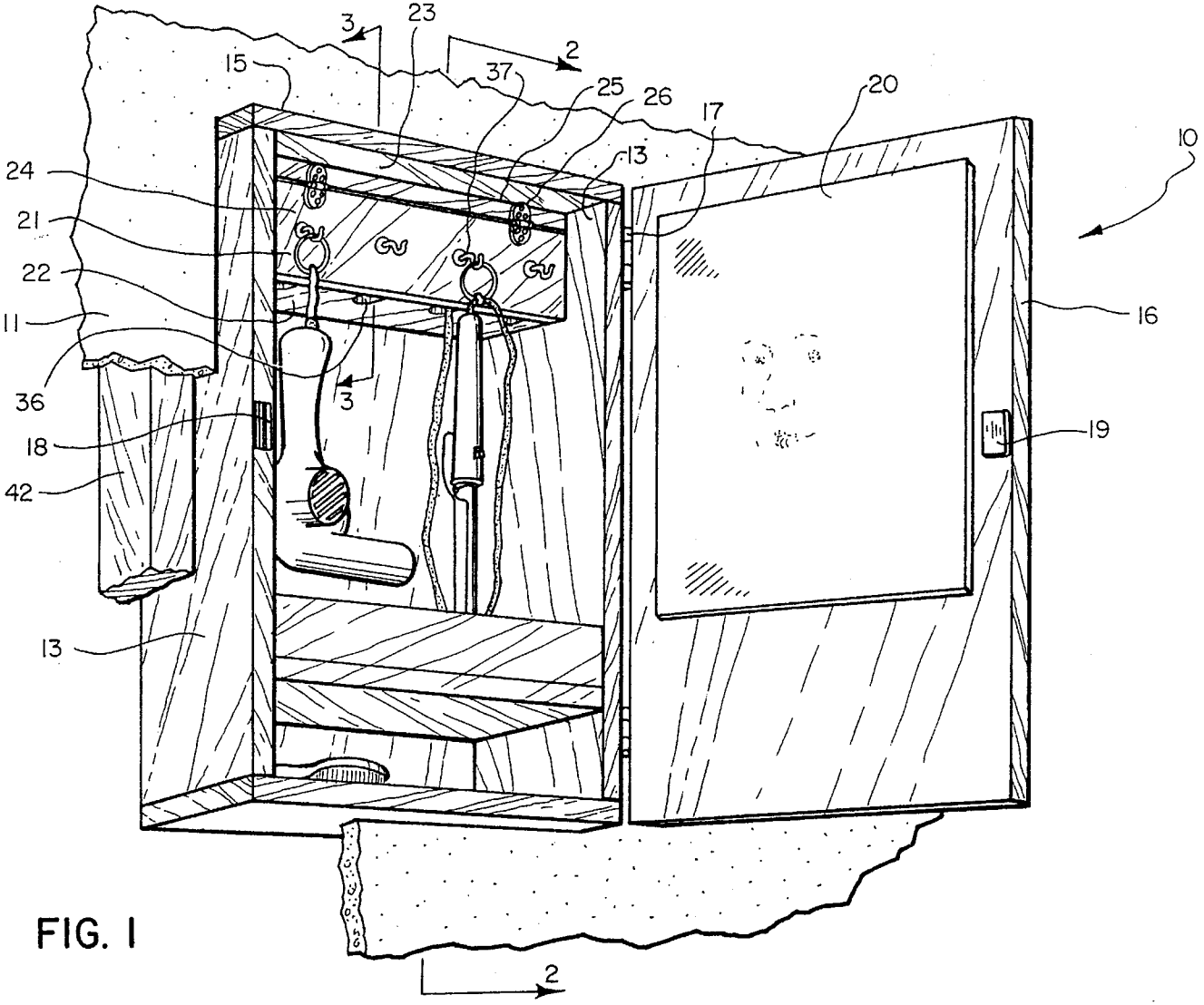
FIG. 1 is a lower left perspective view of a bathroom appliance cabinet in accordance with the invention installed embedded into a bathroom wall and shown with the front door thereof in open position, drawn to a reduced scale, FIG. 2 a cross sectional view of the cabinet of FIG. 1 taken along line 2—2 thereof, drawn to the same scale, FIG. 3 a cross sectional view of a fragment of the cabinet of FIG. 1 taken along line 3—3 thereof, drawn to the same scale, FIG. 4 a cross sectional view of the cabinet of FIG. 3, taken along line 4—4 thereof, drawn to the same scale, FIG. 5 an elevation view of a fragment of the cabinet of FIG. 2, as seen along line 5—5 thereof, drawn to the same scale, FIG. 6 an elevation view of a fragment of the cabinet of FIG. 2, however being an alternate embodiment thereof, drawn to the same scale, and FIG. 7 an elevation view of a fragment of the cabinet of FIG. 2, being another alternate embodiment thereof, drawn to the same scale.
Figure 3:
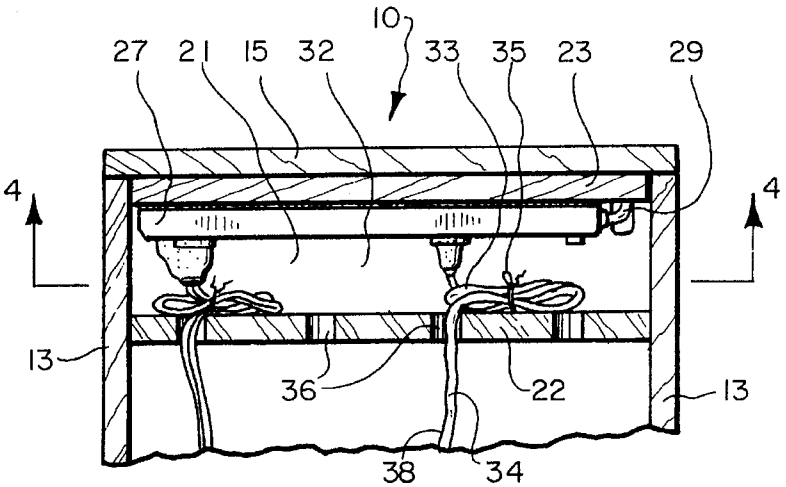
Figure 4:
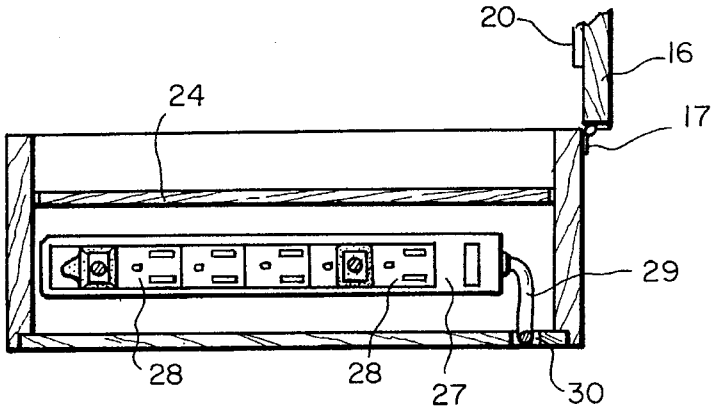

A bathroom appliance 10 in accordance with the invention is shown in the FIGS. 1–6 installed partially embedded into a bathroom wall structure 11. Cabinet 10 comprises rear wall 12 joining with a pair of sidewalls 13, and a bottom and a top wall 14 and 15 respectively. A front door 16 is pivotally connected to one of the sidewalls 13 through a pair of hinges 17. Preferably, cabinet door 16 is latched in closed position by magnetically attracted elements 18 and 19 on the other sidewall 13 and the inside edge of front door 16, respectively. Advantageously, a mirror 20 is mounted upon the inside surface of front door 16, so that implements stored within cabinet 10 may be used without recourse to perhaps distant regular bathroom mirrors.

An interior compartment 21 is formed by a horizontal bottom member 23 spanning between the sidewalls 13, a top compartment member 22, cabinet sidewalls 13 and rear wall 12. A compartment door 24 is horizontally pivoted along its upper edge 25 about compartment hinges 26. Secured to the underside of compartment top member 23 is an electrical power bar 27 carrying electrical plug-in receptacles 28. From power bar 27 a power cord 29 exits cabinet 10 through bore 30 piercing rear cabinet wall 12. Bore 30 connects with a vertical cord exit slot 31 in rear wall 12 and cabinet top wall 15, so that cord 29 does not interfere with mounting cabinet 10 directly against bathroom wall 11, if desired. Cord 29 extends to a distant ground fault interrupter receptacle, not shown, existing or provided for use with cabinet 10.

Compartment bottom member 22, spaced downwardly from power bar 27, provides a storage space 32 for coils 33 of excess lengths of appliance cords 34, advantageously restrained as by nylon cable ties 35. Forwardly opening appliance cord slots 36 in compartment bottom member 22 accommodate the appliance cords, enabling compartment door 24 to hang in its normally closed vertical position butted directly against bottom compartment member 22. Appliance hanging hooks 37 are then provided extending forwardly from compartment door 24.

Figure 2:
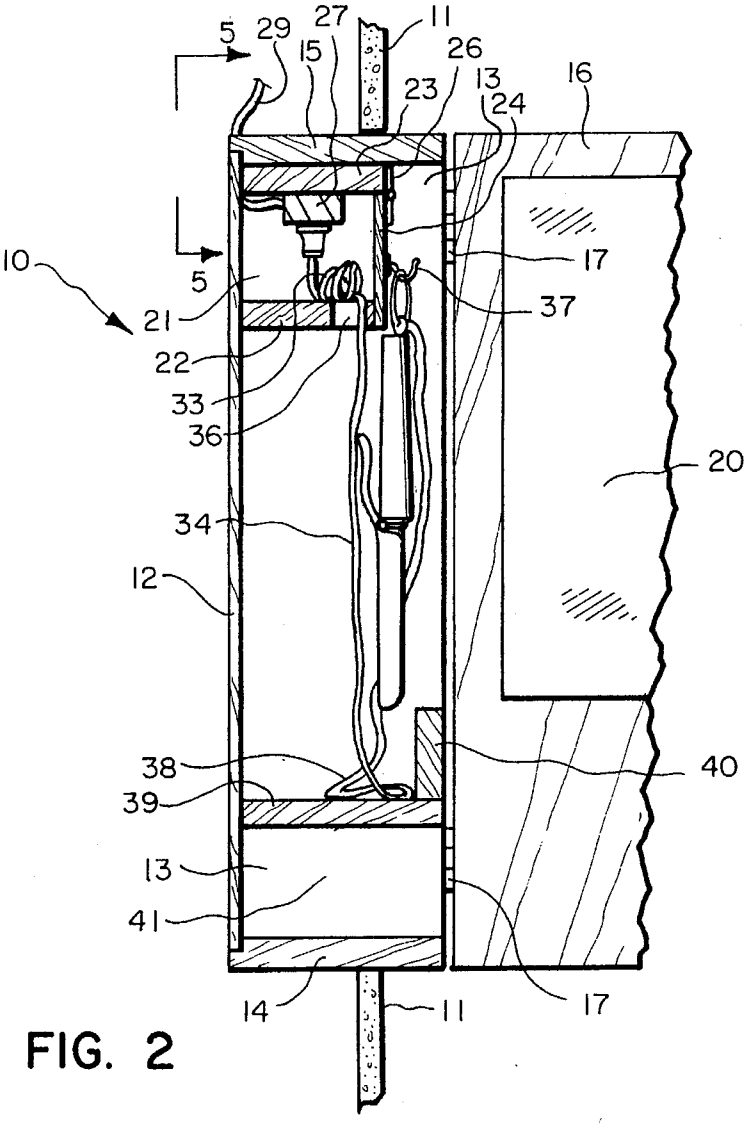

To neatly store uncoiled appliance cord portions 38, a downward shelf member 39 is provided, carrying a low forward cord retaining wall 40. Preferably, lower shelf 39 is spaced upwardly of cabinet bottom 14, providing a lowermost storage space 41 for cordless brushes and combs, for example. (FIGS. 1 and 2)

Bathroom cabinet 10 is illustrated partially inset into the bathroom wall 11, attached to wall studs 42. Other modes of installation may be selected, if desired. By the addition of appropriate suspension members, not shown, cabinet 10 may be hung flush against wall 11, for example, as permitted by the power bar exit slot 31. Flat horizontal bottom member 14 permits upright installation upon a bathroom counter.

Figure 7:
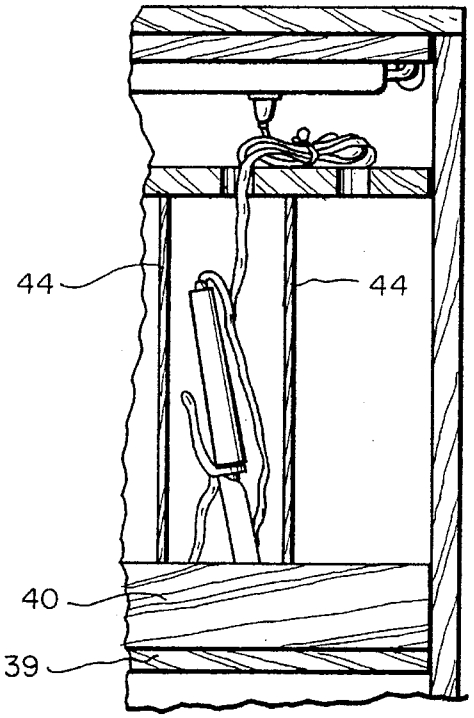
Figure 5:
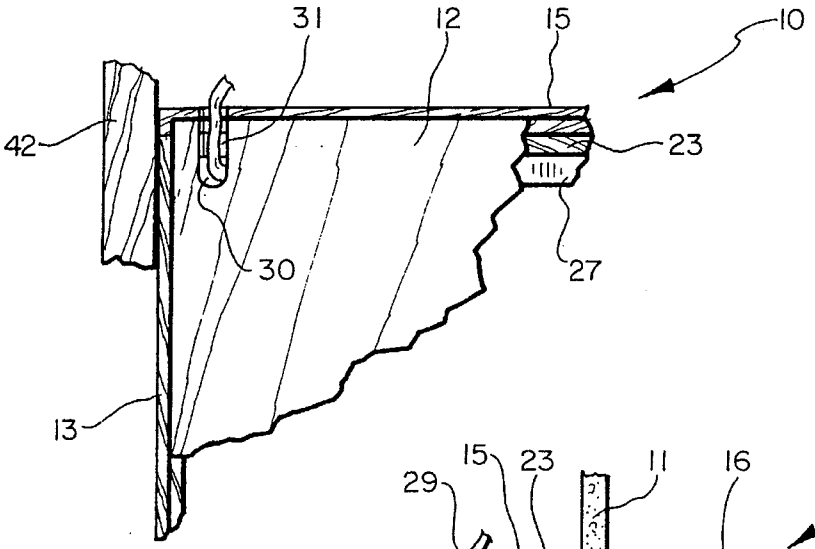
Figure 6:
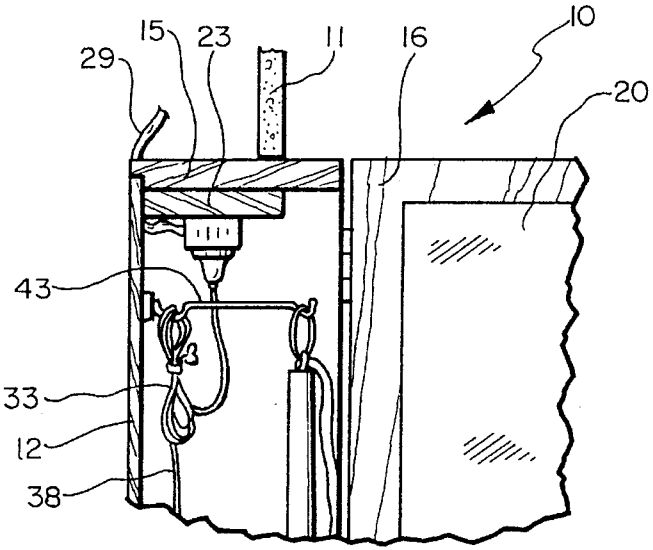

Variations in the illustrated bathroom cabinet 10 itself may still be within the spirit of the invention. One such variation is indicated in FIG. 6, wherein the previously illustrated separate compartment 21 is not utilized, being replaced by elongate suspension hooks 43 extending forwardly from rear wall 12. Coils 32 of excess cord are then suspended from hook 43 near rear wall 12. The appliance itself is hung forwardly on the same hook. In another embodiment, indicated in FIG. 7, separation between stored appliances is achieved by vertical interior partition walls 44, which create individual compartments for the appliances, obviating the need for hanging hooks. Other permissible variations, not illustrated, include mounting of power bar 27 at various other locations within cabinet 10.

These variations, and others neither mentioned nor illustrated, may, within the spirit and scope of the invention as indicated by the appended claims, be embodied therein along with all equivalents thereto.

What is claimed and desired to be secured by United States Letters Patent is:

1. A bathroom appliance cabinet, comprising:

rear, side, top and bottom walls defining a cavity;

an electrical power bar assembly installed within the cavity, including at least one electrical receptacle for the male end of an elongate appliance electrical cord, said power bar being connected to an electrical power supply cord;

means permitting the power bar electrical cord to extend from the cabinet;

means removably retaining at least one electrical appliance and its associated electrical cord within the cavity; wherein the appliance is retained in separated relationship from any other appliance retained with the cavity; said cabinet further comprising means retaining any excess length of the appliance electrical cord within the cavity, during and between uses of said appliance; wherein the cabinet includes a separate compartment contained within the cavity; and the power bar is mounted within the separate compartment, said compartment being shaped and sized to permit plugging in of an appliance cord into the receptacle and to retain any unneeded length of the appliance electrical cord therein, wherein;

the compartment is formed between the top wall, uppermost portions of the sidewalls, and a horizontal member downwardly spaced from the top wall, spanning between the sidewalls, the power bar being secured to the top wall with the receptacle opening downwardly, the foremost extension of the downwardly spaced horizontal member defining a front of the compartment; and a horizontally hinged door closing the front of said compartment.

2. The cabinet of claim 1, wherein:

the horizontally hinged door is secured at an upper edge thereof to hinge means secured to the top wall, said door carrying forwardly extending hook means for suspension of the appliance therefrom separated from any other of said hook means.

* * * * *